United States Patent [19]

Verney Carron

[11] Patent Number: 5,010,677

[45] Date of Patent: Apr. 30, 1991

[54] PLUG FOR SHOTGUN OR RIFLE BARREL USING BLACK POWDER

[76] Inventor: Claude Verney Carron, 23 Ter rue Emile Clermont, 42100 Saint Etienne, France

[21] Appl. No.: 490,343

[22] Filed: Mar. 8, 1990

[30] Foreign Application Priority Data

Dec. 20, 1989 [FR] France ..... 89 17523

[51] Int. Cl.[5] ..... F41A 21/10

[52] U.S. Cl. ..... 42/77; 42/51; 102/446

[58] Field of Search ..... 102/444, 446, 447; 42/51, 77

[56] References Cited

U.S. PATENT DOCUMENTS

| | | | |
|---|---|---|---|
| 4,227,330 | 10/1980 | Chapin | 42/77 |
| 4,232,468 | 11/1980 | Chapin | 42/77 |
| 4,437,249 | 3/1984 | Brown et al. | 42/51 |
| 4,912,868 | 4/1990 | Thompson | 42/77 |

*Primary Examiner*—Charles T. Jordan

*Attorney, Agent, or Firm*—Eckert, Seamans, Cherin & Mellott

[57] ABSTRACT

The plug for shotgun or rifle barrel using black powder is outstanding in that it has a means (2) likely to extract the primer (a) destined to ignite the black powder contained in a chamber (c) of the said plug (1), when the arm is being opened.

4 Claims, 1 Drawing Sheet

PLUG FOR SHOTGUN OR RIFLE BARREL USING BLACK POWDER

The invention relates to all types of firearms designed to take an explosive material, including the black powder type, for firing a projectile. With this type of firing mode, the barrel is plugged at the far end to its muzzle, by a plug designed to take the black powder likely to be ignited by a primer suitably arranged in the said plug.

FIG. 1 shows an embodiment of the plug according to the prior art. The black powder is introduced through the muzzle of the barrel and is stuffed into a chamber of the plug. Coaxially to this chamber, the plug takes a primer (a) of any known type suitable to ignite the powder. It appears, that after the primer has been introduced, the primer collar (a1) is applied facially against the corresponding part of the plug. Therefore, it turns out to be very difficult to extract it with a view to replacing it. More often, an independent means such as a knife blade, screwdriver or other means must be used.

It can be seen that this practice is not very practical and represents an obstacle for this type of firing with black powder.

Therefore, the object of the invention is to overcome these disadvantages in a simple and efficient manner.

The problem the invention intends to solve is to be able to extract the primer easily after firing without having to use an external means. This type of problem is overcome in that the plug has a means likely to extract the primer destined to ignite the black powder contained in the chamber of the said the plug, when the arm is opened.

In an advantageous manner, the extraction means is made up of an elastic component housed in the bottom of a chamber likely to take the primer.

More particularly, the problem the invention intends to overcome, is to enable the primer to partially project when the arm is being opened so as to be able to grab the primer by hand in order to extract it.

This problem is overcome in that the elastic component is designed to enable, firstly, the partial introduction of the primer into the chamber applied against the said component when the arm is being opened and, consequently, the projection of the head of the said primer, and, secondly, the complete introduction of the primer corresponding to the compression of the elastic component when the arm is closed.

In an advantageous manner, the problem brought up is overcome in that the elastic component is a spring which is held in a fixed position in the bottom of the chamber taking the primer.

In order to solve the problem brought up of holding down the spring, the bottom of the chamber has a groove to house at least one coil of the spring.

The invention is described below in more detail with the accompanying drawings, in which.

In order to obtain a better understanding of the rest of the description, it is reminded that the plug, described as a whole as (1), has an internal chamber (c) in which the black powder (P) is stuffed through the muzzle of the barrel (CA) of the arm. Coaxially to the chamber (c) and in communication with this, the plug (1) has another chamber (1*a*) in order to introduce a primer (a). Still in a known manner, the body of the plug (1) can have a thread (1*b*) along part of its length so as to be screwed into the barrel (CA) at the level of the firing chamber. With this in mind, the end of the plug can have arrangements (1*c*) such as recessess likely to cooperate with a corresponding spanner in order to mount and dismantle the plug (1).

Figure 3:
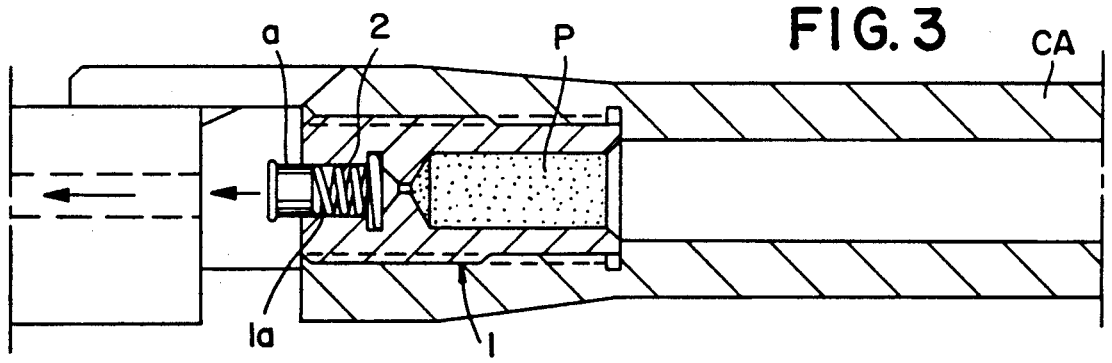
FIG. 3 is a longitudinal section showing the plug mounted in the barrel of a rifle represented in the opening position, i.e. the primer extraction position.

According to the invention, the plug has a means (2) likely to extract the primer (a) without having to use an external means, when the arm is being opened. More particularly, the means (2) is determined so as to enable the primer (a) to partially project in order for it to be grabbed by hand so as to extract it, when the arm is being opened (FIG. 3).

In an advantageous manner, the means (2) is made up of an elastic component housed in the bottom of the chamber (1*a*) taking the primer (a). This elastic component (2) is made up of a compression spring.

Figure 1:
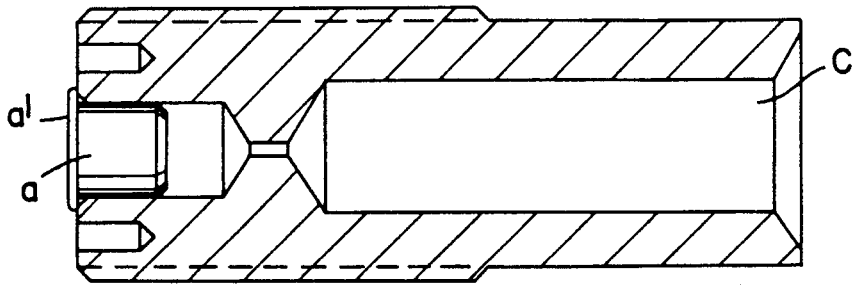
FIG. 1 is a section showing an embodiment of a plug according to the prior art.
Figure 2:
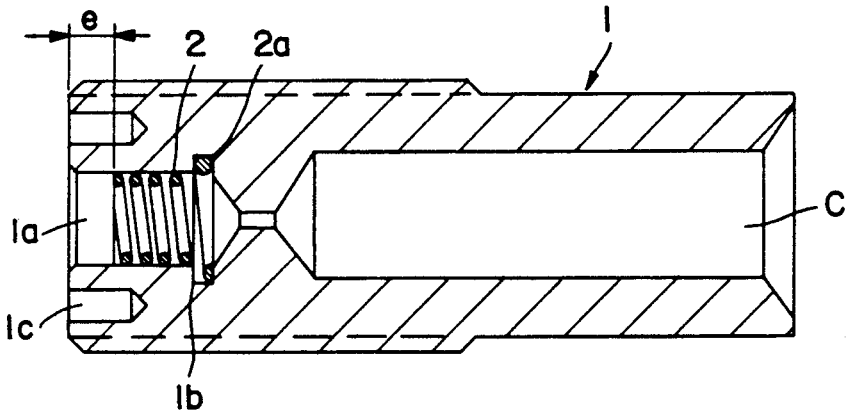
FIG. 2 is a longitudinal section showing the plug executed according to the characteristics of the invention.

As shown in FIG. 2 in particular, the spring (2) is held in a fixed position in the bottom of the chamber (1*a*). With this in mind, the bottom of the chamber (1*a*) has a groove (1*b*) to house at least one couil (2*a*) of the spring. In addition, the length of the spring (2) is determined in order to leave, at the entrance of the chamber (1*a*), when the said spring is not compressed, a free space (e) likely to enable the primer (a) to be partially introduced and held.

Figure 4:
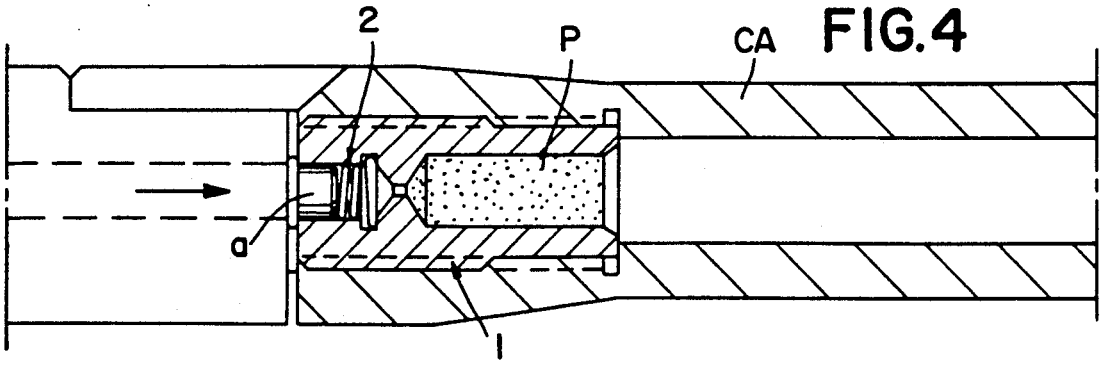
FIG. 4 is a view corresponding to FIG. 3 with the arm in the closing position.

Therefore, it appeared, that when the arm is opened (FIG. 3), the primer (a) is partially introduced into the chamber (1*a*) applied against the spring (2) which is not compressed. In an inverse manner, when the arm is closed, the breech or another part of it, is applied against the head of the primer (a1), thus ensuring it is completely introduced into the plug. The spring (2) is compressed in this closing position (FIG. 4).

Consequently, when the arm is opened, as the primer is no longer held in a position of abutment, it is directly subjected to the releasing action of the spring (2) which automatically causes the said primer to project partially with a view to it being extracted. It is to be noted that the force of the spring (2) can be calculated in order to ensure either the complete and automatic extraction of the primer or its partial projection with a view to being able to grab it easily by hand, when the arm is being opened.

The invention can be apllied to all types of firearms adapted for firing using black powder, of the rifle folding gun or other type.

The advantages are made clearly apparent from the description, the following is to be highlighted and reminded in particular:

the possibilty of extracting the primer easily without having to use external means the simple production and reliability of operation which results.

What is claimed is:

1. A plug for a barrel of a fireman, said firearm using black powder and a primer to ignite the black powder, comprising:

a plug configured for mating engagement with the barrel of the firearm, said plug including a powder chamber adapted to receive the black powder, a primer chamber adapted to receive the primer, and a passageway communicating between the primer chamber and the powder chamber; and, an elastic component housed within the the primer chamber for bearing outwardly on the primer, said elastic component dimensioned to allow at least partial introduction of said primer into the primer chamber, full introduction of the primer into the primer chamber upon closing the firearm, and at least partial projection of the primer from within the primer chamber upon opening the firearm, wherein said elastic component makes direct surface contact with said primer.

2. The plug as recited in claim 1 wherein the elastic component is a spring.

3. The plug according to claim 2 wherein the spring is held in a fixed position in the bottom of said primer chamber.

4. The plug according to claim 3 wherein the bottom of said primer chamber has a groove to house at least one coil of the spring.

* * * * *